US012392230B1

(12) United States Patent
Zhao et al.

(10) Patent No.: US 12,392,230 B1
(45) Date of Patent: Aug. 19, 2025

(54) METHOD AND SYSTEM FOR MULTISTAGE PULSE HYDRAULIC FRACTURING IN DIRECTIONAL LONG DRILLING OF COAL AND ROCK SEAMS IN UNDERGROUND MINES

(71) Applicant: CHINA UNIVERSITY OF MINING AND TECHNOLOGY, Jiangsu (CN)

(72) Inventors: Xinglong Zhao, Jiangsu (CN); Bingxiang Huang, Jiangsu (CN); Shuliang Chen, Jiangsu (CN); Luying Shao, Jiangsu (CN); Haoze Li, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 0 days.

(21) Appl. No.: 19/076,988

(22) Filed: Mar. 11, 2025

Related U.S. Application Data

(63) Continuation of application No. PCT/CN2024/134515, filed on Nov. 26, 2024.

(30) Foreign Application Priority Data

Jun. 17, 2024 (CN) ..... 202410774809.3

(51) Int. Cl.
*E21B 43/26* (2006.01)
*E21B 7/04* (2006.01)
(Continued)

(52) U.S. Cl.
CPC ..... *E21B 43/26* (2013.01); *E21B 7/04* (2013.01); *E21B 21/08* (2013.01); *E21B 49/00* (2013.01)

(58) Field of Classification Search
CPC . E21B 43/26; E21B 7/04; E21B 21/08; E21B 49/00
See application file for complete search history.

(56) References Cited

U.S. PATENT DOCUMENTS 9,732,561 B2 * 8/2017 Carter, Jr. ..... E21B 7/28
2007/0193737 A1 * 8/2007 Miller ..... E21B 43/003 166/263

(Continued)

FOREIGN PATENT DOCUMENTS

CN 108678747 10/2018
CN 117108258 11/2023

(Continued)

OTHER PUBLICATIONS

"International Search Report (Form PCT/ISA/210) of PCT/CN2024/134515," mailed on Jan. 19, 2025, pp. 1-4.

(Continued)

*Primary Examiner* — Catherine Loikith
(74) *Attorney, Agent, or Firm* — JCIPRNET

(57) ABSTRACT

A method and a system for multistage pulse hydraulic fracturing in directional long drilling of coal and rock seams in underground mines are provided, which can perform multistage pulse hydraulic fracturing in directional long drilling of the coal and rock seams, thereby effectively solving the problem of uneven distribution of fractures caused by overall fracturing of long drilling, and the problem of fractures being "dense outside and sparse inside." Further, a pressure of high-frequency pulse water in each stage induces fatigue damage to a coal-rock body, such that multi-directional hydraulic fractures that are not controlled by a crustal stress are formed, native fractures in the coal and rock seams are activated to form a fractures network. The pulse fractures network in each stage is expanded and (Continued)

connected, and an interconnected dense fractures network with uniform distribution of fractures is then formed in the directional long drilling."

11 Claims, 6 Drawing Sheets

(51) Int. Cl.
*E21B 21/08* (2006.01)
*E21B 49/00* (2006.01)

(56) References Cited

U.S. PATENT DOCUMENTS

| | | | | |
|---|---|---|---|---|
| 2013/0333879 | A1* | 12/2013 | Rasheed | E21B 47/013 166/250.1 |
| 2016/0084083 | A1 | 3/2016 | Hice et al. | |
| 2018/0202273 | A1 | 7/2018 | Kasevich et al. | |

FOREIGN PATENT DOCUMENTS

| | | |
|---|---|---|
| CN | 117703374 | 3/2024 |
| CN | 118622267 | 9/2024 |

OTHER PUBLICATIONS

"Written Opinion of the International Searching Authority (Form PCT/ISA/237) of PCT/CN2024/134515," mailed on Jan. 19, 2025, with English translation thereof, pp. 1-9.

* cited by examiner

METHOD AND SYSTEM FOR MULTISTAGE PULSE HYDRAULIC FRACTURING IN DIRECTIONAL LONG DRILLING OF COAL AND ROCK SEAMS IN UNDERGROUND MINES

CROSS-REFERENCE TO RELATED APPLICATION

This application is a continuation of international application of PCT application serial no. PCT/CN2024/134515 filed on Nov. 26, 2024, which claims the priority benefit of China application no. 202410774809.3 filed on Jun. 17, 2024. The entirety of each of the above mentioned patent applications is hereby incorporated by reference herein and made a part of this specification.

TECHNICAL FIELD

The present disclosure relates to the technical field of coal rock fracturing in mines, and particularly relates to a method and equipment for multistage pulse hydraulic fracturing in directional long drilling of coal and rock seams in underground mines, belonging to the technical field of mining engineering.

BACKGROUND

China boasts abundant coal resources. In 2020, China was the world's leading producer of coal, accounting for 50.7% of global total production. In recent years, many coal and gas outbursts, as well as gas explosions, have occurred due to the complex geological conditions of coal seams in underground mines, and these disasters have complex mechanisms. Therefore, gas remains one of the important factors restricting safe production of coal mines. In order to ensure safe and efficient operation of coal mines, efforts should be spared to improve the conventional gas drainage and exploitation methods. New fractures should be introduced into the coal seams by artificial permeability enhancement methods to improve a fracture structure and permeability of the coal seams.

As an important method to improve reservoir permeability and fluid flow performance, hydraulic fracturing involves injecting a fracturing fluid into a reservoir to form a fractures network within a certain range, which can improves the connectivity and permeability of fractures in the reservoir, thereby achieving the purpose of permeability enhancement. Conventional fracturing injects a fracturing fluid into the reservoir by using a high-pressure and high-flow pump. Affected by a crustal stress, a main hydraulic fracture is easily formed in the reservoir, resulting in local stress concentration with fewer branch fractures. Therefore, it is difficult to form a complex fractures network. Compared with the conventional fracturing, pulse hydraulic fracturing adopts pulse circulation pumping to cause fatigue damage to a coal body under the action of high-frequency pulse water pressure, thereby producing hydraulic fractures in various directions that are not controlled by the crustal stress. Moreover, the high-frequency pulse water pressure impacts the coal body to easily activate natural fractures in the coal body, so that the hydraulic fractures are communicated with the natural fractures to form a complex fractures network within the coal body. Frequency and amplitude of the water pressure loading can change a propagation pattern of the fractures network.

Staged fracturing technology is currently widely used in the fracturing of surface oil and gas reservoirs to expand a scope of reservoir fracturing transformation, and improves the effect of fracturing production. However, directional long-distance staged fracturing technology in the underground mines is still at an early stage due to limited operating space, gas safety concerns, reverse pressure gradient hydraulic fracturing in directional long drilling from bottom to top, and limitations of fracturing equipment and sealing technology.

Conventional constant-pumping rate fracturing is prone to forming a main hydraulic fracture in the reservoir. Affected by the crustal stress, hydraulic fractures are single and have poor uniformity, which restricts a scope of coal seam transformation, and some areas may not be fractured, resulting in high gas concentration zones with low gas pressure gradients. As a result, the gas extraction efficiency in the zones is low. Therefore, pulse hydraulic fracturing is needed to form a uniform fractures network, avoiding the formation of small gas pressure gradients and improving the gas extraction efficiency. Furthermore, since high-frequency pulse water of multistage pulse hydraulic fracturing in directional long drilling causes significant damage to the sealing equipment, thereby requiring advanced sealing techniques. In addition, interference may occur between different fracturing intervals, therefore, it is necessary to determine reasonable fracturing points and sealing positions.

Conventional fracturing in coal mines primarily uses an ordinary hydraulic drilling rig for whole-section fracturing of straight boreholes with constant pumping displacement, and a maximum drilling depth is usually less than 200 m. The fracturing process involves manual installation of hole packers and high-pressure sealing columns, resulting in a small action range for a single hole and a large engineering workload.

Directional long-distance drilling refers to drilling conducted with a directional drilling rig that is capable of reaching a depth of more than 200 m, with a controllable drilling direction in a coal mine. Changes in drilling direction and an increased length of borehole pose challenges to the conventional fracturing methods and equipment. In terms of the fracturing methods, the conventional constant-pumping rate fracturing of long-distance drilling results in uneven distribution of fractures throughout the whole section and blind spots in long-hole fracturing transformation. Moreover, a fracture propagation direction of the conventional constant-pumping rate fracturing is controlled by a crustal stress field, resulting in fewer fractures. In terms of fracturing equipment, the conventional fracturing with rigid high-pressure sealing pipe strings cannot adapt to bending changes in a direction of the directional long-distance borehole, and it is impossible to manually install the hole packers and high-pressure sealing pipe strings at a long distance. Therefore, the fracturing in directional long drilling of the coal seams is restricted by technical bottlenecks of uneven distribution of fractures and a limited number of fractures in the conventional constant-pumping rate fracturing throughout the whole section.

SUMMARY

In order to overcome the deficiencies of the existing methods and equipment, the present disclosure provides a method and equipment for multistage pulse hydraulic fracturing in directional long drilling of coal and rock seams in underground mines, which can perform multistage pulse hydraulic fracturing in directional long drilling of coal and rock seams. On the one hand, the multistage fracturing effectively overcomes the problem of uneven distribution of fractures caused by overall fracturing of long drilling, addressing the problems of fractures being "dense outside and sparse inside." On the other hand, high-frequency pulse water pressure is used in each stage to induce fatigue damage to a coal-rock body, such that multi-directional hydraulic fractures that are not controlled by crustal stress are formed, native fractures in the coal and rock seams are activated to form a fractures network. Finally, the pulse fractures network in each stage is expanded and connected, and an interconnected dense fractures network with uniform distribution of fractures is then formed in the directional long drilling. The technology significantly improves the fracturing effect of long borehole fracturing. Moreover, with the help of directional drilling rigs, the method is simple, convenient for construction, easy to operate, and safe and reliable.

Depending on drilling location and position of fractured layers, a multistage pulse hydraulic fracturing process for directional long drilling of an entry along a coal seam of a working face, a multistage pulse hydraulic fracturing process for directional long drilling crossing seams in a bottom extraction entry, a multistage pulse hydraulic fracturing process for directional long drilling of a roof of a soft coal seam, a multistage pulse hydraulic fracturing process for directional long drilling of a hard roof, and the like, are accordingly developed.

Specifically, the multistage pulse hydraulic fracturing process for directional long drilling of an entry along a coal seam of a working face involves performing directional long drilling from a tailentry/headentry of a working face to a hard coal seam, and injecting high-pressure pulse water into the long borehole using a pulse hydraulic fracturing pump to perform multistage pulse hydraulic fracturing on the coal seam. The multistage pulse hydraulic fracturing process for directional long drilling crossing seams in a bottom extraction entry involves performing through-layer directional long drilling from a bottom extraction entry to a harder coal seam, injecting high-pressure pulse water into the borehole to perform multistage pulse hydraulic fracturing and form a fractures network; when the coal seam is relatively soft, borehole collapse is more severe, and fractures formed by fracturing will close quickly under a closure stress. The fractures can be made to penetrate the coal seam by performing directional long drilling of the roof and adopting large-displacement multistage pulse hydraulic fracturing in the long borehole, thus forming an interconnected fractures network in the roof and the coal seam, which is the multistage pulse hydraulic fracturing process for directional long drilling of a roof of a soft coal seam. The multistage pulse hydraulic fracturing process for directional long drilling of a hard roof involves performing directional long drilling from a tailentry/headentry of a working face to a hard roof rock seam above the coal seam, injecting high-pressure pulse water into the borehole using a pulse hydraulic fracturing pump to perform multistage pulse hydraulic fracturing on the hard rock seam.

A method for multistage pulse hydraulic fracturing in directional long drilling of coal and rock seams in underground mines, including the following steps:

S1: designing a trajectory of the directional long drilling according to target seam to be transformed and drilling location, and performing the directional long drilling of the target seam using a directional drilling rig according to the designed trajectory;

S2: determining a number of pulse hydraulic fracturing sections, section length, and sealing position for each fracturing interval of the directional long drilling according to actual drilling trajectory and length of the directional long drilling of the target seam;

S3: reaming a borehole constructed through the directional long drilling to remove debris and other materials in the borehole prior to pulse hydraulic fracturing;

S4: withdrawing drill pipe and drill bit after the borehole is reamed, connecting a sealing device and high-pressure sealing pipe strings, and delivering a high-pressure sealing pipe column and the sealing device to a first fracturing position using the directional drilling rig;

S5: separating the directional drilling rig from a high-pressure sealed directional drill pipe, and connecting the high-pressure sealed directional drill pipe, a high-pressure hose, and a pulse hydraulic fracturing pump;

S6: opening a pulse hydraulic fracturing pump outlet valve, closing a pressure relief valve, and then turning on the pulse hydraulic fracturing pump to perform a first stage of pulse hydraulic fracturing;

S7: turning off the pulse hydraulic fracturing pump to release a pressure after the first stage of pulse hydraulic fracturing is completed, retracting the high-pressure sealed directional drill pipe and the sealing device to a designed sealing position of a second stage using the directional drilling rig;

S8: connecting a high-pressure sealed directional drill pipe joint between the high-pressure hose and the high-pressure sealed directional drill pipe, and turning on the pulse hydraulic fracturing pump again to perform a second stage of pulse hydraulic fracturing;

S9: repeating the steps S5-S8 until the multistage pulse hydraulic fracturing in the entire drilling is completed;

S10: retracting all high-pressure sealed directional drill pipes and sealing devices from the borehole using the directional drilling rig; and S11: observing and evaluating effect of the pulse hydraulic fracturing according to construction purposes of the multistage pulse hydraulic fracturing.

The drilling location in the step S1 is a tailentry/headentry of a working face, a target seam to be transformed is coal seam, and the coal seam is transformed by using the directional drilling rig to construct a directional long drilling in the tailentry/headentry of the working face along the seam for multistage pulse hydraulic fracturing.

The drilling location in the step S1 is a bottom extraction entry of a coal seam, a target seam to be transformed is coal seam, and the coal seam is transformed by using the directional drilling rig to perform directional long drilling crossing seams in the bottom extraction entry along the seam for multistage pulse hydraulic fracturing.

The drilling location in the step S1 is a tailentry/headentry of a working face, and a target seam to be transformed is the soft coal seam. Since the coal seam is soft, serious hole collapse will happen during drilling of the soft coal seam, resulting in poor hole formation, and fractures formed by fracturing will close quickly under a closure stress. The directional drilling rig is used to perform directional long drilling crossing seams to a roof of the coal seam in the tailentry/headentry of the working face for multistage pulse hydraulic fracturing, such that roof fracturing fractures penetrate the soft coal seam to form an interconnected fractures network in the roof and soft coal seam, thereby achieving fracturing transformation of the soft coal seam.

In order to ensure that pulse hydraulic fracturing fractures penetrate from the roof to the soft coal seam; and furthermore, a vertical distance between the directional long drilling of the roof and the soft coal seam should not be greater than 5 m, and fracturing time during pulse hydraulic fracturing should be extended by 20-40 min relative to fracturing in the soft coal seam.

The drilling location in the step S1 is a tailentry/headentry of a working face, the target seam to be transformed is a roof rock seam, and the roof rock seam is transformed by using the directional drilling rig to construct a directional long drilling in the tailentry/headentry of the working face in the roof rock seam for multistage pulse hydraulic fracturing.

The observing and evaluating effect of the pulse hydraulic fracturing according to construction purposes of the multistage pulse hydraulic fracturing in the step S11 specifically includes:

the construction purposes of the multistage pulse hydraulic fracturing in the step S11 includes enhancing permeability of low-permeability coal seams, weakening hard roof coal, and weakening a coal rock strength to reduce impact;

the permeability enhancement by the multistage pulse hydraulic fracturing in directional long drilling of the low-permeability coal seams is to form a uniform fractures network, increase a fracture area and a number of fluid migration channels in the coal seam by the method for multistage pulse hydraulic fracturing, thereby improving reservoir permeability; and the weakening hard roof coal by the multistage pulse hydraulic fracturing in directional long drilling is to form a uniform fractures network in the coal seam on a fully-mechanized working face, fully cut a coal body, and reduce a strength of the coal body by the method for multistage pulse hydraulic fracturing, thereby reducing a caving size of roof coal;

the impact reduction by the multistage pulse hydraulic fracturing in directional long drilling of coal and rock seams is to perform long drilling of a coal seam or rock seam to reach a high-stress zone, perform the multistage pulse hydraulic fracturing in the high-stress zone to weaken the coal and rock seams, transfer a high stress, and reduce the probability of impact hazards in the coal seam or rock seam, thereby ensuring safe and efficient production of a coal mine;

the effect observation of the permeability enhancement by the multistage pulse hydraulic fracturing in directional long drilling of the low-permeability coal seams includes measuring concentration, flow rate, and pure quantity of gas extraction in the borehole after the multistage pulse hydraulic fracturing; when the concentration, flow rate, and pure quantity of gas extraction in the borehole after the multistage pulse hydraulic fracturing increase by more than 50% compared with those before the fracturing, it can be determined that a good effect is achieved; and when the concentration, flow rate, and pure quantity of gas extraction increase by less than 20%, it can be concluded that the fracturing effect is poor;

the effect observation of the weakening hard roof coal by the multistage pulse hydraulic fracturing of directional long drilling includes measuring the caving size of roof coal after the multistage pulse hydraulic fracturing; when the caving size of roof coal after the multistage pulse hydraulic fracturing increases by more than 50% compared with those before the fracturing, it can be determined that a good effect is achieved; and when the caving size of roof coal after the multistage pulse hydraulic fracturing increases by less than 20%, it can be concluded that the fracturing effect is poor; and the effect observation of the impact reduction by the multistage pulse hydraulic fracturing in directional long drilling of coal and rock seams includes measuring impact energy events and energy amplitude of the coal and rock seams after the multistage pulse hydraulic fracturing; when the impact energy events and energy amplitude of the coal and rock seams after the multistage pulse hydraulic fracturing reduce by more than 40% compared with those before the fracturing, it can be determined that a good effect is achieved; and when the impact energy events and energy amplitude of the coal and rock seams after the multistage pulse hydraulic fracturing reduce by less than 20%, it can be concluded that the fracturing effect is poor.

The present disclosure further discloses equipment for multistage pulse hydraulic fracturing in directional long drilling of coal and rock seams in underground mines, including:

a pulse hydraulic fracturing pump, a pulse hydraulic fracturing pump outlet valve, a high-pressure hose, a high-pressure sealed directional drill pipe joint, a high-pressure sealed directional drill pipe, a multistage pulse hydraulic fracturing sealing device, and a drill bit connected in sequence; where a high-pressure hose pressure relief valve, a three-way valve, a flow sensor, and a pressure sensor are arranged on the high-pressure hose in sequence in a fluid flow direction of the pulse hydraulic fracturing pump outlet valve;

the flow sensor is connected to a measurement and control instrument through a flow measurement line and configured to monitor a fluid flow in real time, which is displayed and recorded in real time by the measurement and control instrument;

the pressure sensor is connected to the measurement and control instrument through a pressure measurement line and configured to monitor a fluid pressure in real time, which is displayed and recorded in real time by the measurement and control instrument;

the multistage pulse hydraulic fracturing sealing device includes a kilometer-long directional drilling rig, a plurality of first high-pressure sealed directional drill pipes, a hole packer joint, a proximal end hole packer, a proximal end variable joint, a plurality of second high-pressure sealed directional drill pipes, a distal end variable joint, a distal end hole packer joint, a distal end hole packer, and a high-pressure sealed semi-closed directional drill pipe that are connected in sequence; and the high-pressure sealed semi-closed directional drill pipe is connected between the distal end hole packer and the drill bit, with a closed section at a distal end and an opening at a proximal end.

The high-pressure hose pressure relief valve is a high-pressure wear-resistant ball valve;

the high-pressure sealed directional drill pipe joint, the high-pressure sealed directional drill pipe, the proximal end hole packer joint, the proximal end hole packer, the proximal end variable joint, the distal end variable joint, the distal end hole packer joint, and the distal end hole packer are hollow high-pressure resistant rods;

the high-pressure hose is connected to the high-pressure sealed directional drill pipe joint via a U-shaped clamp; and threaded connections are adopted between the high-pressure sealed directional drill pipe joint and the high-pressure sealed directional drill pipe, between the high-pressure sealed directional drill pipe and the hole packer joint, between the end variable joint and the hole packer, and between the high-pressure sealed directional drill pipes.

The connecting a sealing device and high-pressure sealing pipe strings in the step S4 refers to threaded connections and sealing of the drill bit, the high-pressure sealed semi-closed directional drill pipe, the distal end variable joint, the distal end hole packer joint, the distal end hole packer, the high-pressure sealed directional drill pipes, the proximal end variable joint, the proximal end hole packer, and the proximal end hole packer joint, which are then sequentially delivered into the borehole using the directional drilling rig.

The connecting the high-pressure sealed directional drill pipe, a high-pressure hose, and a pulse hydraulic fracturing pump in the step S5 refers to a sequential connection of the high-pressure sealed directional drill pipe at an outermost end of the borehole to the high-pressure sealed directional drill pipe joint, the high-pressure hose, the flow sensor, the pressure sensor, the high-pressure hose pressure relief valve, the pulse hydraulic fracturing pump outlet valve and the pulse hydraulic fracturing pump, where the high-pressure sealed directional drill pipe joint is connected to the high-pressure hose via a U-shaped clamp; and the flow sensor is connected to a measurement and control instrument through a flow measurement line, and the pressure sensor is connected to the measurement and control instrument through a pressure measurement line.

The pulse hydraulic fracturing process in the step S6 involves injecting pulse water through the pulse hydraulic fracturing pump, where the pulse water sequentially flows through the high-pressure hose, the pulse hydraulic fracturing pump outlet valve, the three-way valve, the flow sensor, the pressure sensor, the high-pressure sealed directional drill pipe joint, the plurality of first high-pressure sealed directional drill pipes, the proximal end hole packer joint, the proximal end hole packer, the proximal end variable joint, the plurality of second high-pressure sealed directional drill pipes, the distal end variable joint, the distal end hole packer joint, the distal end hole packer and the high-pressure sealed semi-closed directional drill pipe. As high-pressure water is injected, the proximal end hole packer and the distal end hole packer expand, such that a sealed space is formed between the hole packers at two ends; when a pressure of the pulse water in the pipeline exceeds a pressure of a one-way valve on the proximal end variable joint and the distal end variable joint, the pulse water enters the sealed space between the proximal end hole packer and the near hole bottom distal end hole packer, and the pulse water and a borehole wall act on the borehole wall to form a damaged fracture zone; and as the pulse water continues to be injected, the damaged fracture zone expands and extends to form a pulse hydraulic fractures network.

Beneficial Effects

Compared with the prior art, the method and equipment for multistage pulse hydraulic fracturing in directional long drilling of coal and rock seams in underground mines of the present disclosure have the following beneficial effects:

first, extraction gas for enhancing permeability of the coal seam, the permeability enhancement and extraction gas for multistage pulse hydraulic fracturing of directional long drilling is to form a uniform fractures network, increase a fracture area and a number of fluid migration channels in the coal seam by the method for multistage pulse hydraulic fracturing, thereby improving reservoir permeability.

Second, weakening hard roof coal, by weakening hard roof coal through multistage pulse hydraulic fracturing of directional long drilling, the system and method of the present disclosure is to form a uniform fractures network in the coal seam on a fully-mechanized working face, fully cut a coal body, and reduce a strength of the coal body by the method for multistage pulse hydraulic fracturing, thereby reducing a caving size of roof coal.

Third, weakening the coal rock strength to reduce impact, the impact reduction by the multistage pulse hydraulic fracturing in directional long drilling of coal and rock seams is to perform long drilling of a coal seam or rock seam to reach a high-stress zone, perform the multistage pulse hydraulic fracturing in the high-stress zone to weaken the coal and rock seams, transfer a high stress, and reduce the probability of impact hazards in the coal seam or rock seam, thereby ensuring safe and efficient production of a coal mine.

Fourth, the multistage pulse hydraulic fracturing in directional long drilling of the present disclosure involves performing multistage pulse hydraulic fracturing in directional long drilling of coal and rock seams, and high-frequency pulse water pressure is used to induce fatigue damage to a coal-rock body, such that multi-directional hydraulic fractures that are not controlled by crustal stress are formed, native fractures in the coal and rock seams are activated to form a fractures network. The technology can effectively overcome the problem of uneven distribution of fractures caused by overall fracturing of long drilling, addressing the problems of fractures being "dense outside and sparse inside." The technology significantly improves the fracturing effect of long borehole fracturing. Moreover, with the help of directional drilling rigs, the method is simple, convenient for construction, easy to operate, and safe and reliable.

Fifth, sealing techniques, the system adopts the "dual-seal medium pressure" technology of sealing technique of multistage pulse hydraulic fracturing in directional long drilling of coal and rock seams in underground mines, two hole packers are connected to the drill rod of a directional drilling rig drilling rig through the drilling rig, the hole packers are pushed to the designated position, and pulse water is injected to expand the hole packers. When the pressure reaches the set level, the one-way valves on the hole packers open, the one-way valve on the hole packer near the borehole bottom opens toward the bolehole mouth, and the one-way valve on the hole packer near the bolehole mouth of opens toward the bolehole bottom, such that pulse water is injected between the two hole packers for fracturing.

Sixth, the design of the multistage pulse hydraulic fracturing position is affected by thickness and undulation of coal seam, as well as directional drilling accuracy, and the directional long borehole may penetrate the rock seam and the coal layer alternately. Because a layer exists between the coal seam and the rock seam, the layer is a weak structure inside the borehole. When the sealing position is arranged in the rock seam, the fractures will mainly propagate along the coal-rock interface. In addition, in order to facilitate backward multistage fracturing, the distance of each stage must be consistent to minimize the number of withdrawal and delivery of drilling rod, improving fracturing efficiency. The design of the sealing position for multistage pulse hydraulic fracturing in directional long drilling raises higher requirements. Therefore, in order to improve the permeability of the coal seam, the sealing positions should be arranged in the coal seam to the greatest extent, while ensuring that the fracturing distance of each section is consistent.

Figure 1:
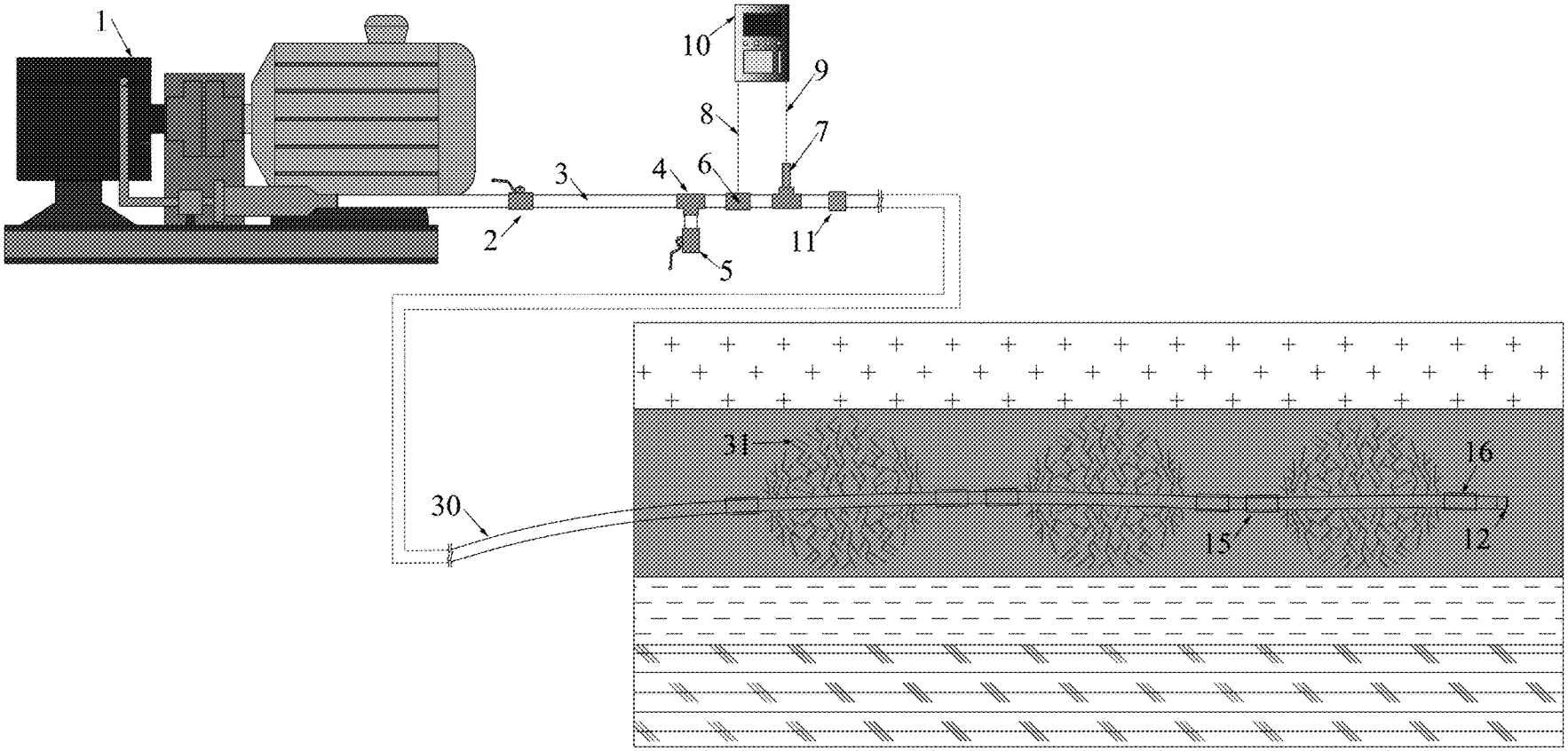
FIG. 1 is a pumping and monitoring system of multistage pulse hydraulic fracturing in directional long drilling according to the present disclosure.

Reference numerals in the accompanying drawings: 1. pulse hydraulic fracturing pump; 2. pulse hydraulic fracturing pump outlet valve; 3. high-pressure hose; 4. three-way valve; 5. high-pressure hose pressure relief valve; 6. flow sensor; 7. pressure sensor; 8. flow measurement line; 9. pressure measurement line; 10. measurement and control instrument; 11. high-pressure sealed directional drill pipe joint; 12. drill bit; 13. first high-pressure sealed directional drill pipe; 14. proximal end hole packer joint; 15. proximal end hole packer; 16. proximal end variable joint; 17. distal end variable joint; 18. near hole-bottom distal end hole packer joint; 19. distal hole packer; 20. high-pressure sealed semi-closed directional drill pipe; 21. fluid channel; 22. water outlet (one-way valve); 23. closed section; 24. fracturing space; 25. roof, 26. coal seam; 27. bottom; 28. coal seam entry; 29. bottom extraction entry; 30. directional long borehole; and 31. fractures network.

DETAILED DESCRIPTIONS OF THE EMBODIMENTS

In order to make the objectives, technical solutions, and advantages of the embodiments of the present disclosure clearer, the technical solutions of the embodiments of the present disclosure will be described clearly and completely with reference to the accompanying drawings of the embodiments of the present disclosure. Apparently, the described embodiments are some, but not all, embodiments of the present disclosure. On the basis of the embodiments in the present disclosure, all other embodiments acquired by those of ordinary skill in the art without making creative efforts fall within the scope of protection of the present disclosure.

Figure 2:
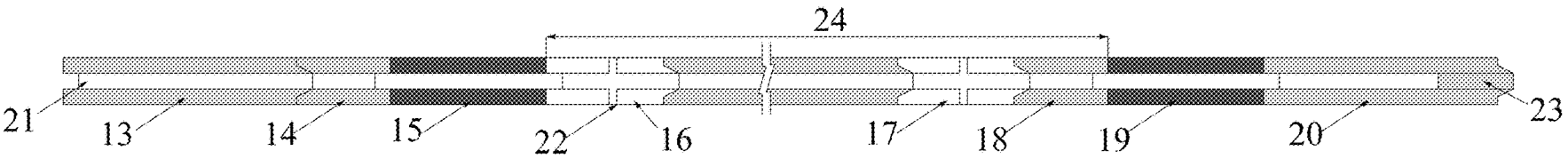
FIG. 2 is pipe strings and sealing device of multistage pulse hydraulic fracturing in directional long drilling according to the present disclosure.

As shown in FIGS. 1 and 2, a multistage pulse hydraulic fracturing equipment for directional long drilling of coal and rock seams includes a pulse hydraulic fracturing pump 1, a pulse hydraulic fracturing pump outlet valve 2, a high-pressure hose 3, a high-pressure sealed directional drill pipe joint 11, a high-pressure sealed directional drill pipe 13, a multistage pulse hydraulic fracturing sealing device, and a drill bit 12 connected in sequence. A high-pressure hose pressure relief valve 5, a three-way valve 4, a flow sensor 6, and a pressure sensor 7 are arranged on the high-pressure hose 3 in sequence in a fluid flow direction of the pulse hydraulic fracturing pump outlet valve 2, where the flow sensor 6 is connected to a measurement and control instrument 10 through a flow measurement line 8, the pressure sensor 7 is connected to the measurement and control instrument 10 through a pressure measurement line 9, and the measurement and control instrument 10 displays and records data in real time.

The multistage pulse hydraulic fracturing sealing device includes a plurality of first high-pressure sealed directional drill pipes 13, a hole packer joint 14, a proximal end hole packer 15, a proximal end variable joint 16, a plurality of second high-pressure sealed directional drill pipes, a distal end variable joint 17, a distal end hole packer joint 18, a distal end hole packer 19, and a high-pressure sealed semi-closed directional drill pipe 20; and the high-pressure sealed semi-closed directional drill pipe 20 is connected between the distal end hole packer and the drill bit, with a closed section 23 at a distal end and is open at the proximal end.

A method for multistage pulse hydraulic fracturing in directional long drilling of coal and rock seams in underground mines includes the following operating steps:

S1: design a trajectory of the directional long drilling according to target seam to be transformed and drilling location, and perform directional long drilling to the target seam using a directional drilling rig according to the designed trajectory;

S2: determine a number of pulse hydraulic fracturing sections, section length, and sealing position for each fracturing interval of the directional long drilling according to actual drilling trajectory and length of the directional long drilling of the target seam;

S3: ream a borehole constructed through the directional long drilling to remove debris and other materials in the borehole prior to pulse hydraulic fracturing;

S4: withdraw drill pipe and drill bit after the borehole is reamed, connect a sealing device and high-pressure sealing pipe strings, and deliver a high-pressure sealing pipe column and the sealing device to a first fracturing position using the directional drilling rig;

S5: separate the directional drilling rig from a high-pressure sealed directional drill pipe, and connect the high-pressure sealed directional drill pipe, a high-pressure hose, and a pulse hydraulic fracturing pump;

S6: open a pulse hydraulic fracturing pump outlet valve, close a pressure relief valve, and then turn on a pulse hydraulic fracturing pump to perform a first stage of pulse hydraulic fracturing;

S7: turn off the pulse hydraulic fracturing pump to release a pressure after the first stage of pulse hydraulic fracturing is completed, retract the high-pressure sealed directional drill pipe and the sealing device to a designed sealing position of a second stage using the directional drilling rig;

S71: turn off the pulse hydraulic fracturing pump and relieve a pressure in a pipeline using a high-pressure hose pressure relief valve;

S72: remove the high-pressure hose from a high-pressure sealed directional drill pipe joint;

S73: remove the high-pressure sealed directional drill pipe joint, retract the high-pressure sealed directional drill pipe using the directional drilling rig, and remove the plurality of second high-pressure sealed directional drill pipes near a near-hole end to allow the sealing device to retreat to a multistage fracturing point of the second stage;

S8: connect a high-pressure sealed directional drill pipe joint between the high-pressure hose and the high-pressure sealed directional drill pipe, and turn on the pulse hydraulic fracturing pump again to perform a second stage of pulse hydraulic fracturing;

S9: repeat the steps S5-S8 until the multistage pulse hydraulic fracturing in the entire drilling is completed;

S10: retract all high-pressure sealed directional drill pipes and sealing devices from the borehole using the directional drilling rig; and S11: observe and evaluate effect of the pulse hydraulic fracturing according to construction purposes of the multistage pulse hydraulic fracturing.

Preferably, a multistage pulse hydraulic fracturing method for a directional long drilling of an entry along a coal seam of a working face, where the drilling location in the step S1 is a tailentry/headentry of a working face, the target seam to be transformed is a coal seam, and the coal seam is transformed by using the directional drilling rig to construct a directional long drilling in the tailentry/headentry of the working face along the seam for multistage pulse hydraulic fracturing;

Preferably, a multistage pulse hydraulic fracturing method for a directional long borehole crossing seams in a bottom extraction entry, where the drilling location in the step S1 is the bottom extraction entry of a coal seam, the target seam to be transformed is a coal seam, and the coal seam is transformed by using the directional drilling rig to perform directional long drilling crossing seams in the bottom extraction entry along the seam for multistage pulse hydraulic fracturing;

preferably, a multistage pulse hydraulic fracturing method for a directional long drilling of a roof of a soft coal seam, where the drilling location in the step S1 is a tailentry/headentry of a working face, and the target seam to be transformed is the soft coal seam. Since the coal seam is soft, serious hole collapse will happen during drilling of the soft coal seam, resulting in poor hole formation, and fractures formed by fracturing will close quickly under a closure stress. The directional drilling rig is used to perform directional long drilling crossing seams to a roof of the coal seam in the tailentry/headentry of the working face for multistage pulse hydraulic fracturing, such that roof fracturing fractures penetrate the soft coal seam to form an interconnected fractures network in the roof and soft coal seam, thereby achieving fracturing transformation of the soft coal seam;

preferably, a multistage pulse hydraulic fracturing method for a directional long drilling of a roof of a soft coal seam, where a vertical distance between the directional long drilling of the roof and the coal seam should not be greater than 5 m, so as to ensure that pulse hydraulic fracturing fractures penetrate from the roof to the soft coal seam; and furthermore, fracturing time during pulse hydraulic fracturing should be extended by about half an hour relative to fracturing in the soft coal seam;

preferably, a multistage pulse hydraulic fracturing method for a directional long drilling of a hard roof, where the drilling location in the step S1 is a tailentry/headentry of a working face, the target seam to be transformed is a roof rock seam, and the roof rock seam is transformed by using the directional drilling rig to construct a directional long drilling in the tailentry/headentry of the working face in the roof rock seam for multistage pulse hydraulic fracturing;

preferably, the connect a sealing device and high-pressure sealing pipe strings in the step S4 refers to threaded connections and sealing of the drill bit, the high-pressure sealed semi-closed directional drill pipe, the distal end variable joint, the distal end hole packer joint, the distal end hole packer, the plurality of high-pressure sealed directional drill pipes, the proximal end variable joint, the proximal end hole packer, the proximal end hole packer joint, and the plurality of high-pressure sealed directional drill pipes, which are then sequentially delivered into the borehole using the directional drilling rig;

preferably, the connect the high-pressure sealed directional drill pipe, a high-pressure hose, and a pulse hydraulic fracturing pump in the step S5 refers to a sequential connection of the high-pressure sealed directional drill pipe at an outermost end of the borehole to the high-pressure sealed directional drill pipe joint, the high-pressure hose, the flow sensor, the pressure sensor, the high-pressure hose pressure relief valve, the pulse hydraulic fracturing pump outlet valve and the pulse hydraulic fracturing pump, where the high-pressure sealed directional drill pipe joint is connected to the high-pressure hose via a U-shaped clamp; and preferably, the flow sensor is connected to a measurement and control instrument through a flow measurement line, and the pressure sensor is connected to the measurement and control instrument through a pressure measurement line.

Preferably, the pulse hydraulic fracturing process in the step S6 involves injecting pulse water through the pulse hydraulic fracturing pump, where the pulse water sequentially flows through the high-pressure hose, the pulse hydraulic fracturing pump outlet valve, the three-way valve, the flow sensor, the pressure sensor, the high-pressure sealed directional drill pipe joint, the plurality of first high-pressure sealed directional drill pipes, the proximal end hole packer joint, the proximal end hole packer, the proximal end variable joint, the plurality of second high-pressure sealed directional drill pipes, the distal end variable joint, the distal end hole packer joint, the distal end hole packer and the high-pressure sealed semi-closed directional drill pipe. As high-pressure water is injected, the proximal end hole packer and the distal end hole packer expand, such that a sealed space is formed between the hole packers at two ends; when a pressure of the pulse water in the pipeline exceeds a pressure of a one-way valve on the proximal end variable joint and the distal end variable joint, the pulse water enters the sealed space between the proximal end hole packer and the distal end hole packer, and the pulse water and a borehole wall act on the borehole wall to form a damaged fracture zone; and as the pulse water continues to be injected, the damaged fracture zone expands and extends to form a pulse hydraulic fractures network;

preferably, the construction purposes of the multistage pulse hydraulic fracturing in the step S11 includes enhancing permeability of low-permeability coal seams, weakening hard roof coal, and weakening a coal rock strength to reduce impact;

preferably, the permeability enhancement by the multistage pulse hydraulic fracturing in directional long drilling of the low-permeability coal seams is to form a uniform fractures network, increase a fracture area and a number of fluid migration channels in the coal seam by the method for multistage pulse hydraulic fracturing, thereby improving reservoir permeability; and preferably, the effect observation of the permeability enhancement by the multistage pulse hydraulic fracturing in directional long drilling of the low-permeability coal seams includes measuring concentration, flow rate, and pure quantity of gas extraction in the borehole after the multistage pulse hydraulic fracturing.

Preferably, the weakening hard roof coal by the multistage pulse hydraulic fracturing in directional long drilling is to form a uniform fractures network in the coal seam on a fully-mechanized working face, fully cut a coal body, and reduce a strength of the coal body by the method for multistage pulse hydraulic fracturing, thereby reducing a caving size of roof coal;

preferably, the effect observation of the weakening hard roof coal by the multistage pulse hydraulic fracturing in directional long drilling includes measuring the caving size of roof coal after the multistage pulse hydraulic fracturing;

preferably, the impact reduction by the multistage pulse hydraulic fracturing in directional long drilling of coal and rock seams is to perform long drilling of a coal seam or rock seam to reach a high-stress zone, perform the multistage pulse hydraulic fracturing in the high-stress zone to weaken the coal and rock seams, transfer a high stress, and reduce the probability of impact hazards in the coal seam or rock seam, thereby ensuring safe and efficient production of a coal mine; and preferably, the effect observation of the impact reduction by the multistage pulse hydraulic fracturing in directional long drilling of coal and rock seams includes measuring impact energy events and energy amplitude of the coal and rock seams after the multistage pulse hydraulic fracturing.

Embodiment 1: Permeability Enhancement and Extraction Gas for Multistage Pulse Hydraulic Fracturing in Directional Long Drilling of an Entry Along a Low-Permeability Coal Seam of a Working Face:

A certain mine is a high-gas mine. An absolute gas emission rate of the mine is 16.62 $m^3$/min, and a relative gas emission rate thereof is 6.86 $m^3$/t; a coal seam dip angle is 1-3 degrees, which is a nearly horizontal coal seam; and a coal seam thickness is 3.52-5.86 m, with an average of 4.62 m.

Figure 3:
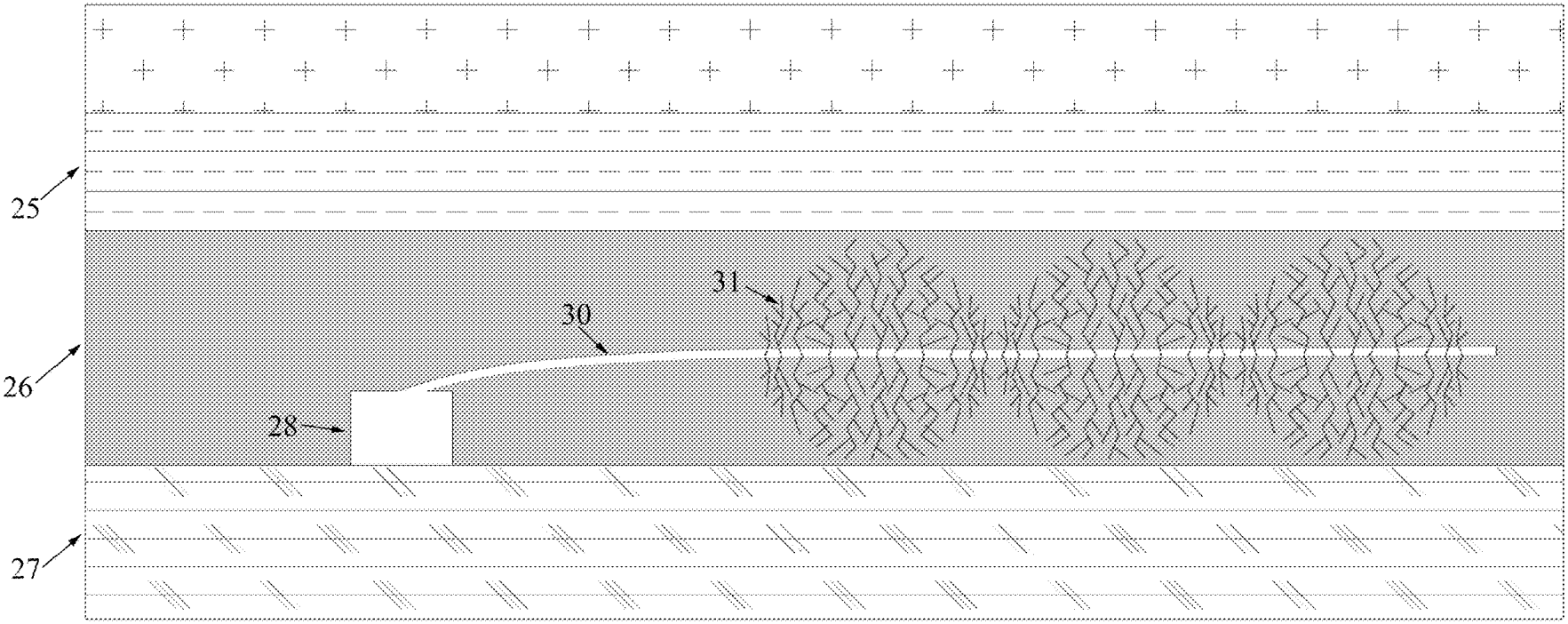
FIG. 3 is multistage pulse hydraulic fracturing process for directional long drilling of an entry along a seam of a working face.

As shown in FIG. 3, provided is permeability enhancement and extraction gas for multistage pulse hydraulic fracturing in directional long drilling of an entry along a low-permeability coal seam of a working face, with operating steps as follows:

(1) a trajectory of the directional long drilling is designed, a directional long borehole 30 is constructed in a tailentry/headentry 28 of a working face along a coal seam 26 for multistage pulse hydraulic fracturing using a directional drilling rig, ensuring that a borehole depth exceeds 50 m to avoid a fracturing fractures network 31 penetrating the entry;

(2) a number of pulse hydraulic fracturing sections, section length, and sealing position for each fracturing interval of the directional long borehole is determined according to actual drilling trajectory and length of the directional long borehole 30 of the target seam;

(3) a borehole constructed through the directional long drilling 30 is reamed to remove debris and other materials in the borehole prior to pulse hydraulic fracturing;

(4) drill pipe and drill bit 12 are withdrawn after the borehole is reamed, the drill bit 12, a high-pressure sealed semi-closed directional drill pipe 20, a distal end hole packer 19, a distal end hole packer joint 18, a distal end variable joint 17, a plurality of high-pressure sealed directional drill pipes 13, a proximal end variable joint 16, a proximal end hole packer 15, a proximal end hole packer joint 14, a plurality of high-pressure sealed directional drill pipes 13, and high-pressure sealed directional drill pipe joint 11 are in threaded connection in sequence and sealed, and are then sequentially delivered to a first fracturing position inside the borehole using the directional drilling rig;

(5) a. the directional drilling rig is separated from a high-pressure sealed directional drill pipe, the high-pressure sealed directional drill pipe at an outermost end, the high-pressure sealed directional drill pipe joint 11, a high-pressure hose 3, a flow sensor 6, a pressure sensor 7, a high-pressure hose pressure relief valve 5, a three-way valve 4, a pulse hydraulic fracturing pump outlet valve 2 and a pulse hydraulic fracturing pump 1 are connected in sequence, where the high-pressure sealed directional drill pipe joint 11 is connected to the high-pressure hose 3 via a U-shaped clamp; and b. the flow sensor 6 is connected to a measurement and control instrument 10 through a flow measurement line 8, and the pressure sensor 7 is connected to the measurement and control instrument through 10 a pressure measurement line 9;

(6) a. the pulse hydraulic fracturing pump outlet valve 2 is opened, and the pressure relief valve 5 is closed to perform a first stage of pulse hydraulic fracturing; b. pulse water is injected through the pulse hydraulic fracturing pump 1, where the pulse sequentially water flows through the high-pressure hose 3, the pulse hydraulic fracturing pump outlet valve 2, the three-way valve 4, the flow sensor 6, the pressure sensor 7, the high-pressure sealed directional drill pipe joint 11, the high-pressure sealed directional drill pipes 13, the proximal end hole packer joint 14, the near-hole-mouth proximal end hole packer 15, the proximal end variable joint 16, the plurality of high-pressure sealed directional drill pipes 13, the distal end variable joint 17, the distal end hole packer joint 18, the distal end hole packer 19 and a fluid channel 21 of the high-pressure sealed semi-closed directional drill pipe 20. As the high-pressure water is injected, the proximal end hole packer 15 and the distal end hole packer 19 expand, such that a sealed fracturing space 24 is formed between the hole packers at two ends; when a pressure of the pulse water in the pipeline exceeds a pressure of a one-way valve on the proximal end variable joint 16 and the distal end variable joint 17, the pulse water enters the sealed fracturing space 24 through a water outlet 22 between the proximal end hole packer 15 and the distal end hole packer 19, and the pulse water and a borehole wall act on the borehole wall to form a damaged fracture zone; and as the pulse water continues to be injected, the damaged fracture zone expands and extends to form a pulse hydraulic fractures network;

(7) the pulse hydraulic fracturing pump is turned off after the first stage of pulse hydraulic fracturing is completed, and the high-pressure sealed directional drill pipe and the sealing device are retracted to a designed sealing position of a second stage using the directional drilling rig;

a. the pulse hydraulic fracturing pump 1 is turned off, and a pressure in a pipeline is relieved using a high-pressure hose pressure relief valve 5; and when the pressure is low or no high-pressure water is sprayed, the pressure relief is continued for 3-5 min to ensure the pressure in the pipeline is completely relieved;

b. the high-pressure hose 3 is removed from the high-pressure sealed directional drill pipe joint 11;

c. the high-pressure sealed directional drill pipe joint 11 is removed, the high-pressure sealed directional drill pipe is retracted using the directional drilling rig, and the high-pressure sealed directional drill pipes 13 near a near-hole end are removed to allow the sealing device to retreat to a multistage fracturing point of the second stage;

(8) the high-pressure sealed directional drill pipe joint 11 is connected between the high-pressure hose 3 and the high-pressure sealed directional drill pipe 13, and the pulse hydraulic fracturing pump 1 is turned on again to perform a second stage of pulse hydraulic fracturing;

(9) the steps S5-S8 are repeated until the multistage pulse hydraulic fracturing in the entire drilling is completed;

(10) all high-pressure sealed directional drill pipes and sealing devices are retracted from the borehole using the directional drilling rig;

(11) gas extraction is performed, a multistage pulse hydraulic fracturing system and the drill bit 12 were withdrawn from the borehole, and the gas extraction pipeline is connected to extract gas from the coal seam in the area;

(12) the multistage pulse hydraulic fracturing system of directional long borehole is moved to a next borehole, and steps 1-10 are repeated to enhance permeability and extract gas from the working face or designated area; and

(13) during the gas extraction, gas concentration, flow rate, and pure quantity of an extraction borehole are monitored, and effect of the pulse hydraulic fracturing is observed and evaluated.

Embodiment 2: Permeability Enhancement and Outburst Elimination for Multistage Pulse Hydraulic Fracturing in Directional Long Drilling of a Bottom Extraction Entry of a Low-Permeability Coal Seam A certain coal mine is an outburst mine. A working face is located in an initial mining face of an eastern wing of a second mining district, the working face is a monocline structure on the whole, with no faults exposed on a surface; and a mined coal seam is a No. 9 coal seam, with a burial depth of 100-300 m; and a coal seam dip angle is 4-7 degrees, a thickness thereof is 2.00-4.47 m, and an average thickness is 3.18 m. A gas pressure in the coal seam is 0.07-0.91 MPa, and gas content is 9.20-14.41 $m^3/t$. An initial velocity of diffusion of gas is 18-29 mmHg, a coal hardness factor (f) is 1.00-1.70, and a failure type of coal is Class II. A permeability coefficient of the coal seam is 0.140-0.636 $m^2/(MPa^2 \cdot d)$.

Figure 4:
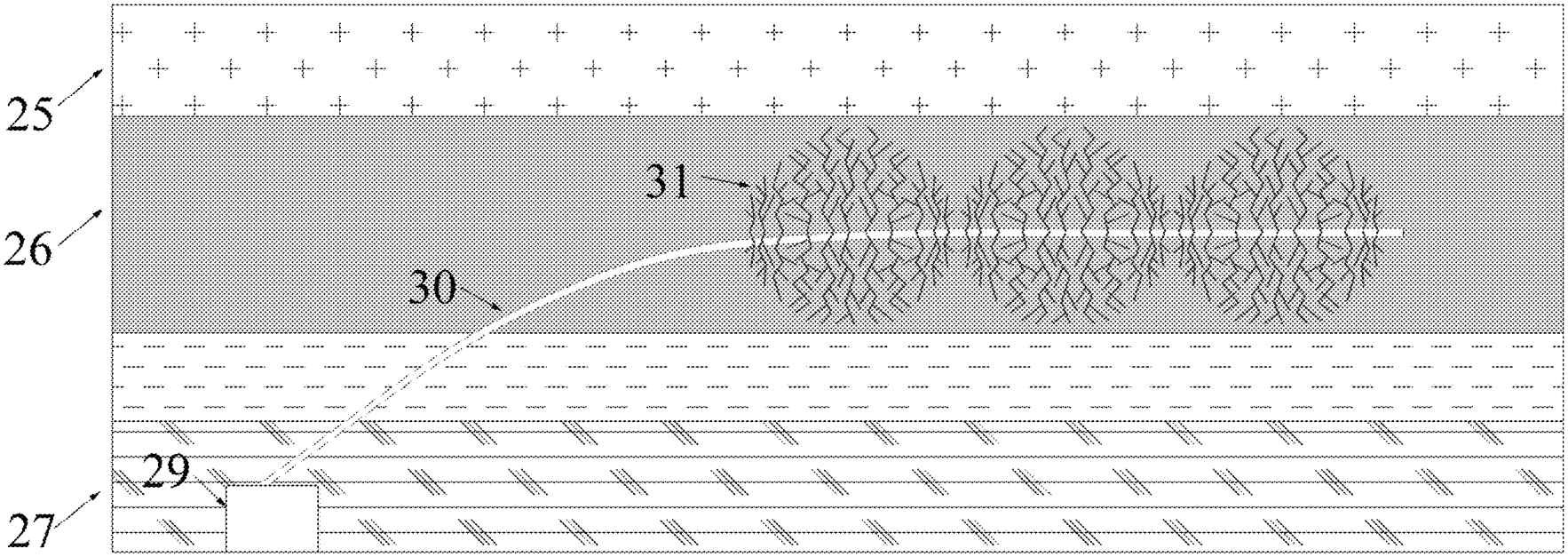
FIG. 4 is multistage pulse hydraulic fracturing process for directional long drilling crossing seams in a bottom extraction entry.

As shown in FIG. 4, provided is a method for the permeability enhancement and outburst elimination for multistage pulse hydraulic fracturing in directional long drilling of a bottom extraction entry of a low-permeability coal seam, with operating steps as follows:

(1) a trajectory of the directional long drilling is designed, a directional long borehole 30 is constructed in a bottom extraction entry 29 of a coal seam bottom 27 to a coal seam 26 for multistage pulse hydraulic fracturing using a directional drilling rig, ensuring that a borehole depth exceeds 50 m to avoid a fracturing fractures network 31 penetrating the entry;

(2) a number of pulse hydraulic fracturing sections, section length, and sealing position for each fracturing interval of the directional long borehole is determined according to actual drilling trajectory and length of the directional long borehole 30 of the target seam;

(3) a borehole constructed through the directional long drilling 30 is reamed to remove debris and other materials in the borehole prior to pulse hydraulic fracturing;

(4) drill pipe and drill bit 12 are withdrawn after the borehole is reamed, the drill bit 12, a high-pressure sealed semi-closed directional drill pipe 20, a distal end hole packer 19, a distal end hole packer joint 18, a distal end variable joint 17, a plurality of high-pressure sealed directional drill pipes 13, a proximal end variable joint 16, a proximal end hole packer 15, a proximal end hole packer joint 14, a plurality of high-pressure sealed directional drill pipes 13, and high-pressure sealed directional drill pipe joint 11 are in threaded connection in sequence and sealed, and are then sequentially delivered to a first fracturing position inside the borehole using the directional drilling rig;

(5) a. the directional drilling rig is separated from a high-pressure sealed directional drill pipe, the high-pressure sealed directional drill pipe at an outermost end, the high-pressure sealed directional drill pipe joint 11, a high-pressure hose 3, a flow sensor 6, a pressure sensor 7, a high-pressure hose pressure relief valve 5, a three-way valve 4, a pulse hydraulic fracturing pump outlet valve 2 and a pulse hydraulic fracturing pump 1 are connected in sequence, where the high-pressure sealed directional drill pipe joint 11 is connected to the high-pressure hose 3 via a U-shaped clamp; and b. the flow sensor 6 is connected to a measurement and control instrument 10 through a flow measurement line 8, and the pressure sensor 7 is connected to the measurement and control instrument through 10 a pressure measurement line 9;

(6) a. the pulse hydraulic fracturing pump outlet valve 2 is opened, and the pressure relief valve 5 is closed to perform a first stage of pulse hydraulic fracturing; b. pulse water is injected through the pulse hydraulic fracturing pump 1, where the pulse sequentially water flows through the high-pressure hose 3, the pulse hydraulic fracturing pump outlet valve 2, the three-way valve 4, the flow sensor 6, the pressure sensor 7, the high-pressure sealed directional drill pipe joint 11, the plurality of first high-pressure sealed directional drill pipes 13, the proximal end hole packer joint 14, the proximal end hole packer 15, the proximal end variable joint 16, the plurality of second high-pressure sealed directional drill pipes 13, the distal end variable joint 17, the distal end hole packer joint 18, the distal end hole packer 19 and a fluid channel 21 of the high-pressure sealed semi-closed directional drill pipe 20. As the high-pressure water is injected, the proximal end hole packer 15 and the distal end hole packer 19 expand, such that a sealed fracturing space 24 is formed between the hole packers at two ends; when a pressure of the pulse water in the pipeline exceeds a pressure of a one-way valve on the proximal end variable joint 16 and the distal end variable joint 17, the pulse water enters the sealed fracturing space 24 through a water outlet 22 between the proximal end hole packer 15 and the distal end hole packer 19, and the pulse water and a borehole wall act on the borehole wall to form a damaged fracture zone; and as the pulse water continues to be injected, the damaged fracture zone expands and extends to form a pulse hydraulic fractures network;

(7) the pulse hydraulic fracturing pump is turned off after the first stage of pulse hydraulic fracturing is completed, and the high-pressure sealed directional drill pipe and the sealing device are retracted to a designed sealing position of a second stage using the directional drilling rig;

a. the pulse hydraulic fracturing pump 1 is turned off and a pressure in a pipeline is relieved using a high-pressure hose pressure relief valve 5; and when the pressure is low or no high-pressure water is sprayed, the pressure relief is continued for 3-5 min to ensure the pressure in the pipeline is completely relieved;

b. the high-pressure hose 3 is removed from the high-pressure sealed directional drill pipe joint 11;

c. the high-pressure sealed directional drill pipe joint 11 is removed, the high-pressure sealed directional drill pipe is retracted using the directional drilling rig, and the high-pressure sealed directional drill pipes 13 near a near-hole end are removed to allow the sealing device to retreat to a multistage fracturing point of the second stage;

(8) the high-pressure sealed directional drill pipe joint 11 is connected between the high-pressure hose 3 and the high-pressure sealed directional drill pipe 13, and the pulse hydraulic fracturing pump 1 is turned on again to perform a second stage of pulse hydraulic fracturing;

(9) the steps S5-S8 are repeated until the multistage pulse hydraulic fracturing in the entire drilling is completed;

(10) all high-pressure sealed directional drill pipes and sealing devices are retracted from the borehole using the directional drilling rig;

(11) gas extraction is performed, a multistage pulse hydraulic fracturing system and the drill bit 12 were withdrawn from the borehole, and the gas extraction pipeline is connected to extract gas from the coal seam in the area;

(12) the multistage pulse hydraulic fracturing system of directional long borehole is moved to a next borehole, and steps 1-10 are repeated to enhance permeability and outburst elimination from the working face or designated area; and

(13) during the gas extraction, gas concentration, flow rate, and pure quantity of an extraction borehole are monitored, and effect of the pulse hydraulic fracturing is observed and evaluated.

Embodiment 3: Permeability Enhancement and Outburst Elimination for Multistage Pulse Hydraulic Fracturing in Directional Long Drilling of a Roof of a Soft Coal Seam A certain coal mine is an outburst mine. An average design strike length of a fully-mechanized working face is 1850 m, with a dip length of 200 m. The coal seam occurrence is relatively stable, with a coal seam dip angle of 0°-12°, an average of 6°, and a coal seal thickness of 4 m-20 m, with an average thickness of 13.4 m. According to a comprehensive analysis of nearby drilling data, 1-4 layers of interlayer gangue are identified, and lithology is mostly mudstone, with a thickness of 0.2 m-0.3 m. When the coal seam is relatively soft, a coal hardness factor (f) is 1.20-1.60, and a roof of the coal seam is fine sandstone.

Figure 5:
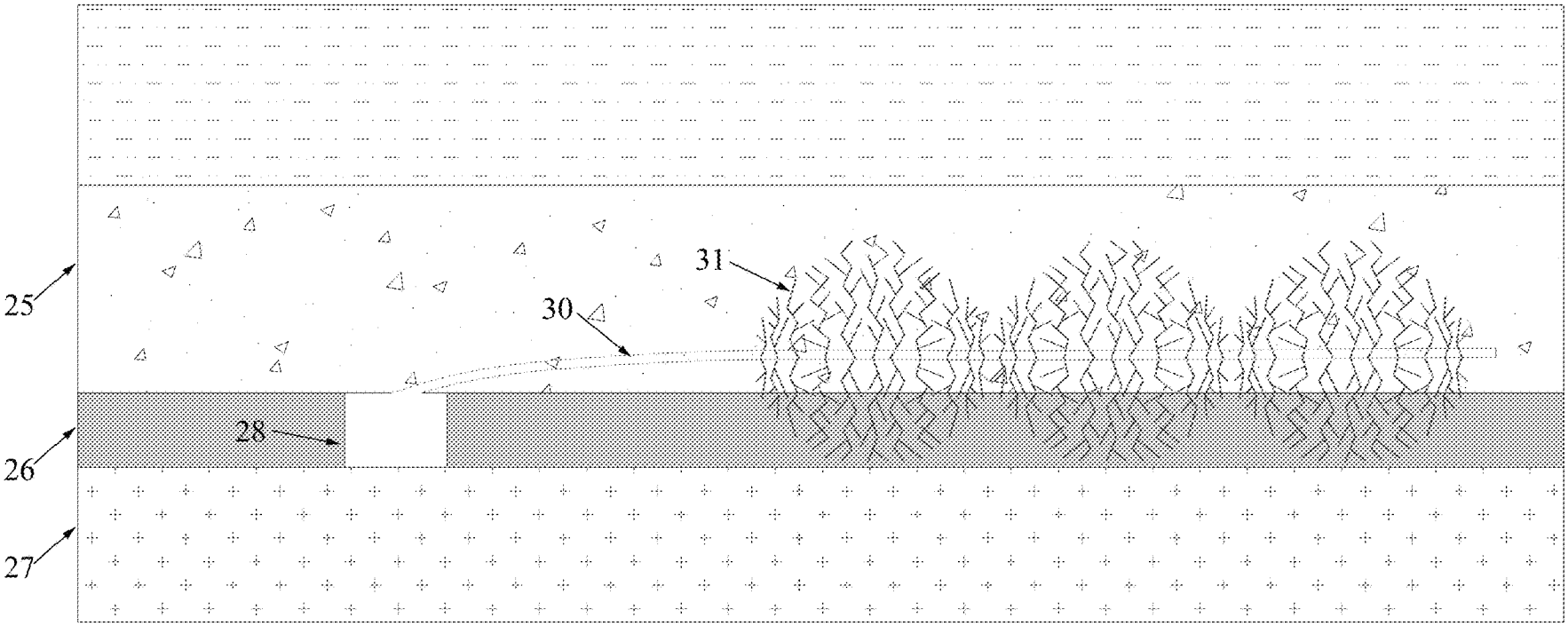
FIG. 5 is multistage pulse hydraulic fracturing process for directional long drilling of a roof of a soft coal seam.

As shown in FIG. 5, provided is a method for the permeability enhancement and outburst elimination for multistage pulse hydraulic fracturing in directional long drilling of a roof of a soft coal seam, with operating steps as follows:

(1) a trajectory of the directional long drilling is designed, a directional long borehole 30 is constructed in a tailentry/headentry 28 of a working face of a roof 25 for multistage pulse hydraulic fracturing using a directional drilling rig, ensuring that a borehole depth exceeds 50 m to avoid a fracturing fractures network 31 penetrating the entry; and in order to ensure that the fracturing fractures network 31 can penetrate the coal seam, a vertical distance between the directional long drilling of the roof 25 and the coal seam 26 should not be greater than 5 m;

(2) a number of pulse hydraulic fracturing sections, section length, and sealing position for each fracturing interval of the directional long borehole is determined according to actual drilling trajectory and length of the directional long borehole 30 of the target seam;

(3) a borehole constructed through the directional long drilling 30 is reamed to remove debris and other materials in the borehole prior to pulse hydraulic fracturing;

(4) drill pipe and drill bit 12 are withdrawn after the borehole is reamed, the drill bit 12, a high-pressure sealed semi-closed directional drill pipe 20, a distal end hole packer 19, a distal end hole packer joint 18, a distal end variable joint 17, a plurality of high-pressure sealed directional drill pipes 13, a proximal end variable joint 16, a proximal end hole packer 15, a proximal end hole packer joint 14, a plurality of high-pressure sealed directional drill pipes 13, and high-pressure sealed directional drill pipe joint 11 are in threaded connection in sequence and sealed, and are then sequentially delivered to a first fracturing position inside the borehole using the directional drilling rig;

(5) a. the directional drilling rig is separated from a high-pressure sealed directional drill pipe, the high-pressure sealed directional drill pipe at an outermost end, the high-pressure sealed directional drill pipe joint 11, a high-pressure hose 3, a flow sensor 6, a pressure sensor 7, a high-pressure hose pressure relief valve 5, a three-way valve 4, a pulse hydraulic fracturing pump outlet valve 2 and a pulse hydraulic fracturing pump 1 are connected in sequence, where the high-pressure sealed directional drill pipe joint 11 is connected to the high-pressure hose 3 via a U-shaped clamp; and b. the flow sensor 6 is connected to a measurement and control instrument 10 through a flow measurement line 8, and the pressure sensor 7 is connected to the measurement and control instrument through 10 a pressure measurement line 9;

(6) a. the pulse hydraulic fracturing pump outlet valve 2 is opened, and the pressure relief valve 5 is closed to perform a first stage of pulse hydraulic fracturing; b. pulse water is injected through the pulse hydraulic fracturing pump 1, where the pulse water sequentially flows through the high-pressure hose 3, the pulse hydraulic fracturing pump outlet valve 2, the three-way valve 4, the flow sensor 6, the pressure sensor 7, the high-pressure sealed directional drill pipe joint 11, the plurality of first high-pressure sealed directional drill pipes 13, the proximal end hole packer joint 14, the proximal end hole packer 15, the proximal end variable joint 16, the plurality of second high-pressure sealed directional drill pipes 13, the distal end variable joint 17, the distal end hole packer joint 18, the distal end hole packer 19 and a fluid channel 21 of the high-pressure sealed semi-closed directional drill pipe 20. As the high-pressure water is injected, the proximal end hole packer 15 and the distal end hole packer 19 expand, such that a sealed fracturing space 24 is formed between the hole packers at two ends; when a pressure of the pulse water in the pipeline exceeds a pressure of a one-way valve on the proximal end variable joint 16 and the distal end variable joint 17, the pulse water enters the sealed fracturing space 24 through a water outlet 22 between the proximal end hole packer 15 and the distal end hole packer 19, and the pulse water and a borehole wall act on the borehole wall to form a damaged fracture zone; as the pulse water continues to be injected, the damaged fracture zone expands and extends to form a pulse hydraulic fractures network; and in order to enable fractures from the roof pulse hydraulic fracturing to penetrate the coal seam to form a connected fractures network in the roof and the coal seam, fracturing time during pulse hydraulic fracturing should be extended by about half an hour relative to fracturing in the coal seam, thereby achieving fracturing transformation of the soft coal seam;

(7) the pulse hydraulic fracturing pump is turned off after the first stage of pulse hydraulic fracturing is completed, and the high-pressure sealed directional drill pipe and the sealing device are retracted to a designed sealing position of a second stage using the directional drilling rig;

a. the pulse hydraulic fracturing pump 1 is turned off and a pressure in a pipeline is relieved using a high-pressure hose pressure relief valve 5; and when the pressure is low or no high-pressure water is sprayed, the pressure relief is continued for 3-5 min to ensure the pressure in the pipeline is completely relieved;

b. the high-pressure hose 3 is removed from the high-pressure sealed directional drill pipe joint 11;

c. the high-pressure sealed directional drill pipe joint 11 is removed, the high-pressure sealed directional drill pipe is retracted using the directional drilling rig, and the high-pressure sealed directional drill pipes 13 near a near-hole end are removed to allow the sealing device to retreat to a multistage fracturing point of the second stage;

(8) the high-pressure sealed directional drill pipe joint 11 is connected between the high-pressure hose 3 and the high-pressure sealed directional drill pipe 13, and the pulse hydraulic fracturing pump 1 is turned on again to perform a second stage of pulse hydraulic fracturing;

(9) the steps S5-S8 are repeated until the multistage pulse hydraulic fracturing in the entire drilling is completed;

(10) all high-pressure sealed directional drill pipes and sealing devices are retracted from the borehole using the directional drilling rig;

(11) gas extraction is performed, a multistage pulse hydraulic fracturing system and the drill bit 12 were withdrawn from the borehole, and the gas extraction pipeline is connected to extract gas from the coal seam in the area;

(12) the multistage pulse hydraulic fracturing system of directional long borehole is moved to a next borehole, and steps 1-10 are repeated to enhance permeability and outburst elimination from the working face or designated area; and

(13) during the gas extraction, gas concentration, flow rate, and pure quantity of an extraction borehole are monitored, and effect of the pulse hydraulic fracturing is observed and evaluated.

Embodiment 4: Multistage Pulse Hydraulic Fracturing Process for Directional Long Drilling of a Hard Roof A coal mine is a rock burst mine. Drilling data from a 170 bolehole in a middle of a working face indicates that medium-grained sandstone with a thickness of 30.87 m exists at 9.24 m above the working face. Another layer of fine-grained sandstone, with a thickness of 13.38 m, exists at 87.71 m away from the coal seam, resulting in many microseismic high-energy events during a recovery process of the working face.

Figure 6:
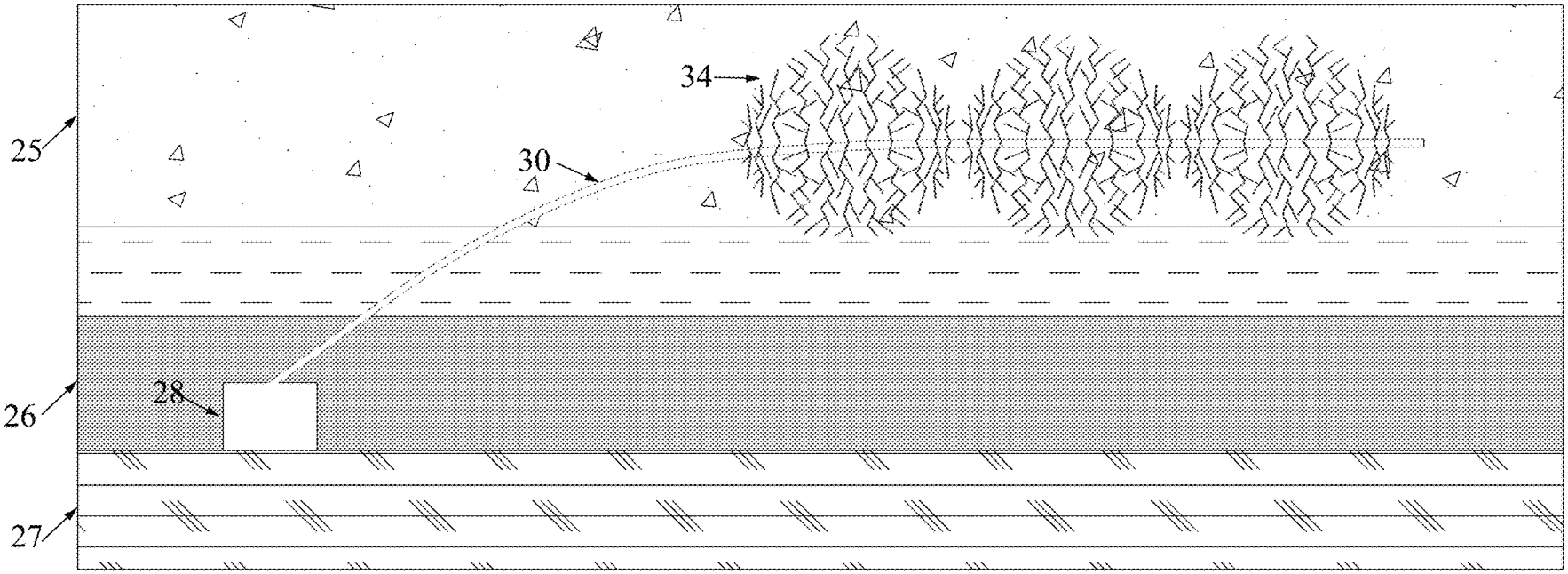
FIG. 6 is multistage pulse hydraulic fracturing process for directional long drilling of a hard roof.

Provided is a multistage pulse hydraulic fracturing method for directional long drilling of a hard roof (FIG. 6), with operating steps as follows:

(1) a trajectory of the directional long drilling is designed, a directional long borehole 30 is constructed in a coal seam entry 28 of a working face toward a hard roof 25 above the coal seam, ensuring that a borehole depth exceeds 50 m to avoid a fracturing fractures network 31 penetrating the entry;

(2) a number of pulse hydraulic fracturing sections, section length, and sealing position for each fracturing interval of the directional long borehole is determined according to actual drilling trajectory and length of the directional long borehole 30 of the target seam;

(3) a borehole constructed through the directional long drilling 30 is reamed to remove debris and other materials in the borehole prior to pulse hydraulic fracturing;

(4) drill pipe and drill bit 12 are withdrawn after the borehole is reamed, the drill bit 12, a high-pressure sealed semi-closed directional drill pipe 20, a distal end hole packer 19, a distal end hole packer joint 18, a distal end variable joint 17, a plurality of high-pressure sealed directional drill pipes 13, a proximal end variable joint 16, a proximal end hole packer 15, a proximal end hole packer joint 14, a plurality of high-pressure sealed directional drill pipes 13, and high-pressure sealed directional drill pipe joint 11 are in threaded connection in sequence and sealed, and are then sequentially delivered to a first fracturing position inside the borehole using the directional drilling rig;

(5) a. the directional drilling rig is separated from a high-pressure sealed directional drill pipe, the high-pressure sealed directional drill pipe at an outermost end, the high-pressure sealed directional drill pipe joint 11, a high-pressure hose 3, a flow sensor 6, a pressure sensor 7, a high-pressure hose pressure relief valve 5, a three-way valve 4, a pulse hydraulic fracturing pump outlet valve 2 and a pulse hydraulic fracturing pump 1 are connected in sequence, where the high-pressure sealed directional drill pipe joint 11 is connected to the high-pressure hose 3 via a U-shaped clamp; and b. the flow sensor 6 is connected to a measurement and control instrument 10 through a flow measurement line 8, and the pressure sensor 7 is connected to the measurement and control instrument through 10 a pressure measurement line 9;

(6) a. the pulse hydraulic fracturing pump outlet valve 2 is opened, and the pressure relief valve 5 is closed to perform a first stage of pulse hydraulic fracturing; b. pulse water is injected through the pulse hydraulic fracturing pump 1, where the pulse water sequentially flows through the high-pressure hose 3, the pulse hydraulic fracturing pump outlet valve 2, the three-way valve 4, the flow sensor 6, the pressure sensor 7, the high-pressure sealed directional drill pipe joint 11, the plurality of first high-pressure sealed directional drill pipes 13, the proximal end hole packer joint 14, the proximal end hole packer 15, the proximal end variable joint 16, the plurality of second high-pressure sealed directional drill pipes 13, the distal end variable joint 17, the distal end hole packer joint 18, the distal end hole packer 19 and a fluid channel 21 of the high-pressure sealed semi-closed directional drill pipe 20. As the high-pressure water is injected, the proximal end hole packer 15 and the distal end hole packer 19 expand, such that a sealed fracturing space 24 is formed between the hole packers at two ends; when a pressure of the pulse water in the pipeline exceeds a pressure of a one-way valve on the proximal end variable joint 16 and the distal end variable joint 17, the pulse water enters the sealed fracturing space 24 through a water outlet 22 between the proximal end hole packer 15 and the distal end hole packer 19, and the pulse water and a borehole wall act on the borehole wall to form a damaged fracture zone; and as the pulse water continues to be injected, the damaged fracture zone expands and extends to form a pulse hydraulic fractures network;

(7) the pulse hydraulic fracturing pump is turned off after the first stage of pulse hydraulic fracturing is completed, and the high-pressure sealed directional drill pipe and the sealing device are retracted to a designed sealing position of a second stage using the directional drilling rig;

a. the pulse hydraulic fracturing pump 1 is turned off and a pressure in a pipeline is relieved using a high-pressure hose pressure relief valve 5; and when the pressure is low or no high-pressure water is sprayed, the pressure relief is continued for 3-5 min to ensure the pressure in the pipeline is completely relieved;

b. the high-pressure hose 3 is removed from the high-pressure sealed directional drill pipe joint 11;

c. the high-pressure sealed directional drill pipe joint 11 is removed, the high-pressure sealed directional drill pipe is retracted using the directional drilling rig, and the high-pressure sealed directional drill pipes 13 near a near-hole end are removed to allow the sealing device to retreat to a multistage fracturing point of the second stage;

(8) the high-pressure sealed directional drill pipe joint 11 is connected between the high-pressure hose 3 and the high-pressure sealed directional drill pipe 13, and the pulse hydraulic fracturing pump 1 is turned on again to perform a second stage of pulse hydraulic fracturing;

(9) the steps S5-S8 are repeated until the multistage pulse hydraulic fracturing in the entire drilling is completed;

(10) all high-pressure sealed directional drill pipes and sealing devices are retracted from the borehole using the directional drilling rig;

(11) the multistage pulse hydraulic fracturing system of directional long borehole is moved to a next borehole, and steps 1-10 are repeated to enhance permeability and extract gas from the working face or designated area; and

(12) impact reduction effect is evaluated. During the working face recovery process, high-energy microseismic events caused by roof rock seam fractures are monitored, and frequency and intensity of high-energy microseismic events before and after fracturing are compared and analyzed, so as to evaluate impact reduction effect of multistage pulse hydraulic fracturing in directional long drilling of the hard roof.

What is described above is merely preferred embodiments of the present disclosure, and is not intended to limit the present disclosure in any form. Any simple amendments, equivalent changes and modifications made to the above embodiments according to the technical essence of the present disclosure all fall within the scope of protection of the present disclosure.

What is claimed is:

1. A method for a multistage pulse fracturing in a directional long drilling of coal and rock seams in underground mines, comprising:

S1: designing a trajectory of the directional long drilling according to a target seam to be transformed and a drilling location, and performing the directional long drilling of the target seam using a directional drilling rig according to the designed trajectory;

S2: determining a number of pulse hydraulic fracturing sections, section length, and sealing position for each fracturing interval of the directional long drilling according to actual drilling trajectory and length of the directional long drilling of the target seam;

S3: reaming a borehole constructed through the directional long drilling using the directional drilling rig to remove debris in the borehole prior to a pulse hydraulic fracturing;

S4: withdrawing a drill pipe and a drill bit after the borehole is reamed, connecting a sealing device and a high-pressure sealing pipe column, and delivering the high-pressure sealing pipe column and the sealing device to a first fracturing position using the directional drilling rig;

S5: separating the directional drilling rig from a high-pressure sealed drill pipe, and connecting the high-pressure sealed drill pipe, a high-pressure hose, and a pulse hydraulic fracturing pump;

S6: opening a pulse pump outlet valve, closing a pressure relief valve, and then turning on the pulse hydraulic fracturing pump to perform a first stage of pulse fracturing;

S7: turning off the pulse hydraulic fracturing pump to release a pressure after the first stage of pulse fracturing is completed, retracting the high-pressure sealed drill pipe and the sealing device to a designed sealing position of a second stage using the directional drilling rig;

S8: connecting a high-pressure sealed directional drill pipe joint between the high-pressure hose and a high-pressure sealed directional drill pipe, and turning on the pulse hydraulic fracturing pump again to perform a second stage of pulse hydraulic fracturing;

S9: repeating the steps S5-S8 until the multistage pulse fracturing in the entire borehole is completed;

S10: retracting all high-pressure sealed drill pipes and sealing devices from the borehole using the directional drilling rig; and S11: observing and evaluating effects of the pulse hydraulic fracturing according to construction purposes of the multistage pulse fracturing, wherein the observing and evaluating the effects of the pulse hydraulic fracturing according to the construction purposes of the multistage pulse fracturing in S11 specifically comprises:

the permeability enhancement by the multistage pulse fracturing in the directional long drilling of the low-permeability coal seams is to form a uniform fractures network, and increase a fracture area and increase a number of fluid migration channels in coal seams by the method for multistage pulse fracturing, thereby improving a reservoir permeability;

the weakening hard roof coal by the multistage pulse fracturing in the directional long drilling is to form a uniform fractures network in the coal seams, fully cut a coal body, and reduce a strength of the coal body on a fully-mechanized working face, thereby reducing a caving size of roof coal;

an impact reduction by the multistage pulse fracturing in the directional long drilling of the coal and rock seams is to perform a long drilling of a coal seam or a rock seam to reach a high-stress zone, perform the multistage pulse fracturing in the high-stress zone to weaken the coal and rock seams, transfer a high stress, and reduce a probability of impact hazards in the coal seam or the rock seam, thereby ensuring a safe and efficient production of a coal mine;

an effect observation of the permeability enhancement by the multistage pulse fracturing in the directional long drilling of the low-permeability coal seams comprises a concentration, a flow rate, and a pure quantity of a gas extraction in a borehole after the multistage pulse fracturing; when the concentration, the flow rate, and the pure quantity of the gas extraction in the borehole after the multistage pulse fracturing increase by more than 50% compared with those before fracturing, determining that a good effect is achieved; and when the concentration, the flow rate, and the pure quantity of the gas extraction increase by less than 20%, concluding that an effect is poor;

an effect observation of the weakening hard roof coal by the multistage pulse fracturing in the directional long drilling comprises the caving size of roof coal after the multistage pulse fracturing; when the caving size of roof coal after the multistage pulse fracturing increases by more than 50% compared with those before fracturing, determining that a good effect is achieved; and when the caving size of roof coal after the multistage pulse fracturing increases by less than 20%, concluding that an effect is poor; and an effect observation of the impact reduction by the multistage pulse fracturing in the directional long drilling of the coal and rock seams comprises impact energy events and energy amplitude of the coal and rock seams after the multistage pulse fracturing; when the impact energy events and the energy amplitude of the coal and rock seams after the multistage pulse fracturing reduce by more than 40% compared with those before fracturing, determining that a good effect is achieved; and when the impact energy events and the energy amplitude of the coal and rock seams after the multistage pulse fracturing reduce by less than 20%, concluding that an effect is poor.

2. The method for the multistage pulse fracturing in the directional long drilling of the coal and rock seams in the underground mines according to claim 1, wherein, the drilling location in S1 is a tailentry/headentry of a working face, the target seam to be transformed is a coal seam, and the coal seam is transformed by using the directional drilling rig to perform a directional long drilling along seams in the tailentry/headentry of the working face for the multistage pulse fracturing.

3. The method for multistage pulse fracturing in the directional long drilling of the coal and rock seams in the underground mines according to claim 1, wherein the drilling location in S1 is a bottom extraction entry of a coal seam, the target seam to be transformed is a coal seam, and the coal seam is transformed by using the directional drilling rig to perform a directional long drilling crossing seams in the bottom extraction entry for the multistage pulse fracturing.

4. The method for the multistage pulse fracturing in the directional long drilling of the coal and rock seams in the underground mines according to claim 1, wherein the drilling location in S1 is a tailentry/headentry of a working face, and the target seam to be transformed is a soft coal seam; and the directional drilling rig is used to perform a directional long drilling crossing seams to a roof of the coal seam in the tailentry/headentry of the working face for the multistage pulse fracturing, such that roof fracturing fractures penetrate the soft coal seam to form an interconnected fractures network in the roof and the soft coal seam, thereby achieving a fracturing transformation of the soft coal seam.

5. The method for the multistage pulse fracturing in the directional long drilling of the coal and rock seams in the underground mines according to claim 4, wherein ensuring that pulse fracturing fractures penetrate from the roof to the soft coal seam; a vertical distance between the directional long drilling of the roof and the soft coal seam is not greater than 5 m, and fracturing time during the pulse fracturing is extended by 20-40 mins relative to fracturing in the soft coal seam.

6. The method for the multistage pulse fracturing in the directional long drilling of the coal and rock seams in the underground mines according to claim 1, wherein the drilling location in S1 is a tailentry/headentry of a working face, the target seam to be transformed is a roof rock seam, and the roof rock seam is transformed by using the directional drilling rig to perform a directional long drilling crossing seams to the roof rock seam in the tailentry/headentry of the working face for the multistage pulse fracturing.

7. A system for multistage pulse fracturing used in the method for the multistage pulse fracturing in the directional long drilling of the coal and rock seams in the underground mines according to claim 1, comprising:

a pulse pump, a pulse pump outlet valve, a high-pressure hose, a high-pressure sealed directional drill pipe joint, a high-pressure sealed directional drill pipe, a multistage pulse hydraulic fracturing sealing device, and a drill bit connected in sequence; wherein the pulse pump outlet valve, a high-pressure hose pressure relief valve, a three-way valve, a flow sensor, and a pressure sensor are arranged on the high-pressure hose in sequence in a fluid flow direction;

the flow sensor is connected to a measurement and control instrument through a flow measurement line and configured to monitor a fluid flow in real time, which is displayed and recorded in real time by the measurement and control instrument;

the pressure sensor is connected to the measurement and control instrument through a pressure measurement line and configured to monitor a fluid pressure in real time, which is displayed and recorded in real time by the measurement and control instrument;

the multistage pulse fracturing sealing device comprises a kilometer-long directional drilling rig, a plurality of first high-pressure sealed directional drill pipes, a hole packer joint, a proximal end hole packer, a proximal end variable joint, a plurality of second high-pressure sealed directional drill pipes, a distal end variable joint, a distal end hole packer joint, a distal end hole packer, and a high-pressure sealed semi-closed directional drill pipe that are connected in sequence; and the high-pressure sealed semi-closed directional drill pipe is connected between the distal end hole packer and the drill bit, with a distal end being closed and a proximal end being opened.

8. The system for multistage pulse fracturing according to claim 7, wherein the high-pressure hose pressure relief valve is a high-pressure wear-resistant ball valve;

the high-pressure sealed directional drill pipe joint, the high-pressure sealed directional drill pipe, the proximal end hole packer joint, the proximal end hole packer, the proximal end variable joint, the distal end variable joint, the distal end hole packer joint, and the distal end hole packer are hollow high-pressure resistant rods;

the high-pressure hose is connected to the high-pressure sealed directional drill pipe joint via a U-shaped clamp; and threaded connections are adopted between the high-pressure sealed directional drill pipe joint and the high-pressure sealed directional drill pipe, between the high-pressure sealed directional drill pipe and the hole packer joint, between the end variable joint and the hole packer, and between the high-pressure sealed directional drill pipes.

9. The system for multistage pulse fracturing according to claim 7, wherein the connecting the sealing device and the high-pressure sealing pipe column in S4 refers to threaded connections and sealing of the drill bit, the high-pressure sealed semi-closed directional drill pipe, the distal end hole packer, the distal end hole packer joint, the distal end variable joint, a plurality of the high-pressure sealed directional drill pipes, the proximal end variable joint, the proximal end hole packer, the proximal end hole packer joint, and a plurality of the high-pressure sealed directional drill pipes, which are then sequentially delivered into the borehole using the directional drilling rig.

10. The system for multistage pulse fracturing according to claim 7, wherein the connecting the high-pressure sealed directional drill pipe, the high-pressure hose, and the pulse hydraulic fracturing pump in S5 refers to a sequential connection of the high-pressure sealed directional drill pipe at an outermost end of the borehole to the high-pressure sealed directional drill pipe joint, the high-pressure hose, the flow sensor, the pressure sensor, the high-pressure hose pressure relief valve, the pulse pump outlet valve and the pulse hydraulic fracturing pump, wherein the high-pressure sealed directional drill pipe joint is connected to the high-pressure hose via a U-shaped clamp; and the flow sensor is connected to the measurement and control instrument through the flow measurement line, and the pressure sensor is connected to the measurement and control instrument through the pressure measurement line.

11. The system for multistage pulse fracturing according to claim 7, wherein the pulse hydraulic fracturing process in S6 involves injecting a pulse water through the pulse hydraulic fracturing pump, the pulse water sequentially flows through the high-pressure hose, the pulse hydraulic fracturing pump outlet valve, the three-way valve, the flow sensor, the pressure sensor, the high-pressure sealed directional drill pipe joint, the plurality of first high-pressure sealed directional drill pipes, the proximal end hole packer joint, the proximal end hole packer, the proximal end variable joint, the plurality of second high-pressure sealed directional drill pipes, the distal end variable joint, the distal end hole packer joint, the distal end hole packer, and the high-pressure sealed semi-closed directional drill pipe; as a high-pressure water is injected, the proximal end hole packer and the distal end hole packer expand, such that a sealed space is formed between the hole packers at two ends; when a pressure of the pulse water in the high-pressure hose exceeds a pressure of a one-way valve on the proximal end variable joint and the distal end variable joint, the pulse water enters the sealed space between the proximal end hole packer and the distal end hole packer, and the pulse water acts on a borehole wall to form a damaged fracture zone on the borehole wall; and as the pulse water continues to be injected, the damaged fracture zone expands and extends to form a pulse hydraulic fractures network.

* * * * *